US006345725B1

(12) United States Patent
Lin

(10) Patent No.: US 6,345,725 B1
(45) Date of Patent: Feb. 12, 2002

(54) WASTE BIN STRUCTURE

(76) Inventor: Tsong-Yow Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/770,752

(22) Filed: Jan. 19, 2001

(51) Int. Cl.[7] ..... B65D 43/26
(52) U.S. Cl. ..... 220/263; 220/828; 220/908
(58) Field of Search ..... 220/263, 264, 220/828, 849, 378, 908

(56) References Cited

U.S. PATENT DOCUMENTS 4,785,964 A * 11/1988 Miller et al. ..... 220/263
4,913,308 A * 4/1990 Culbertson ..... 220/263
5,163,574 A * 11/1992 Susan ..... 220/263
5,170,904 A * 12/1992 Neuhaus ..... 220/263
5,230,525 A * 7/1993 Delmerico et al. ..... 220/263
5,249,693 A * 10/1993 Gillispie et al. ..... 220/263
5,295,607 A * 3/1994 Chang ..... 220/263
5,531,348 A * 7/1996 Baker et al. ..... 220/263
6,024,238 A * 2/2000 Jaros ..... 220/263

* cited by examiner

*Primary Examiner*—Joseph M. Moy

(57) ABSTRACT

A waste bin structure includes an inner barrel, an outer barrel, and a barrel lid. The lid cover includes an inner cover, an outer cover, and a locking portion. The inner cover is provided with a touch portion that may be pressed to pivot the inner cover upward independently. The outer barrel has a connecting portion defining a hanging recess, and the inner barrel is provided with a hanging hook portion secured in the hanging recess. The outer barrel is provided with a hood to form a handle portion of the outer barrel, so that the outer barrel is portable. The lid cover of the waste bin structure can be opened by a triggering action, and alternatively by a stepping action of a foot.

1 Claim, 14 Drawing Sheets

WASTE BIN STRUCTURE

FIELD OF THE INVENTION

The present invention relates to a waste bin structure, and more particularly to a waste bin structure that can be opened by a triggering action, and by a stepping action of a user's foot so that the waste bin structure has dual functions and effects.

DESCRIPTION OF THE RELATED PRIOR ART

A conventional waste bin is used for storing wastes or rubbish therein. However, the conventional waste bin is not provided with a cover or lid, so that the wastes are directly in contact with the air of the ambient environment. Therefore, when the wastes are organism that are derived from the kitchen, for example, the odor of the wastes will leak from the waste bin to the ambient environment, thereby causing uncomfortable sensation to the people. In addition, the conventional waste bin is not provided with a cover or lid, so that the wastes are exposed to the ambient environment, thereby decreasing the aesthetic appearance of the conventional waste bin.

A first conventional covered waste bin includes an upper cover formed with a protrusion so that the user can hold the protrusion for removing the upper cover. However, the user has to operate the upper cover manually, thereby causing inconvenience to the user.

A second conventional covered waste bin includes a single cover piece. However, its airtight effect is not sufficient, so that the odor of the wastes easily leaks from the waste bin to the ambient environment.

A third conventional covered waste bin includes a pedal having a bottom pivoted with a linking lever set, whereby the pedal can be stepped so that the linking lever set is driven to push an upper cover for removing the upper cover. The third conventional covered waste bin has a better airtight effect, however, it is not easy to clean the waste bin.

A fourth conventional covered waste bin includes a barrel lid having a trigger point which may be pressed so that the locking set mounted in the barrel lid can be locked or released, so as to close or open the upper cover. However, the operation of the barrel lid is not suitable for a large waste bin, so that the volume of the waste bin is limited.

SUMMARY OF THE INVENTION

The present invention has arisen to mitigate and/or obviate the disadvantage of the conventional waste bin.

The primary objective of the present invention is to provide a waste bin structure which can be opened by a triggering action, and by a stepping action of a user's foot so that the waste bin structure has dual functions and effects.

Another objective of the present invention is to provide a waste bin structure which can be opened by a triggering action, or by a stepping action of a user's foot, depending on the volume of wastes, by means of the pivotal connection of an inner cover and an outer cover of a barrel cover.

A further objective of the present invention is to provide a waste bin structure, wherein the gap between the inner barrel and the outer barrel can be covered by means of the pivotal mounting of the outer cover of the barrel cover, thereby preventing the wastes from falling into the gap between the inner barrel and the outer barrel.

A further objective of the present invention is to provide a waste bin structure which may be portable by mounting of a handle portion of the outer barrel.

A further objective of the present invention is to provide a waste bin structure which includes an inner barrel that can be removed to be cleaned. In addition, the inner barrel is provided with a hanging hook for hanging the inner barrel into the outer barrel without wobbling. Further, the hanging hook of the inner barrel may also function as a handle, so that the inner barrel is portable.

Thus, in accordance with the present invention, there is provided a waste bin structure comprising:

an inner barrel, an outer barrel, and a barrel lid, the inner barrel received in the outer barrel, a connecting portion mounted on a rear end of an inner rim of the outer barrel, the connecting portion having a top face integrally formed with a cover, the cover having a front end provided with two hanging shafts, the barrel lid having a distal end provided with two hanging ears each snapped on the hanging shaft of the cover so that the barrel lid covers a top edge of the outer barrel, the barrel lid provided with a locking portion that is opened and closed by triggering, so that the barrel lid can be opened by triggering action, the connecting portion of the outer barrel having a center defining a channel, a linking lever received in the channel and having a first end formed with a horizontal bent portion passing through a protruding ear of a bottom of a rear end of the barrel lid, and a second end passing through a front end of the outer barrel and pivoted with a pedal which may be stepped so that the linking lever pushes the lid cover to pivot upward;

the improvement comprising:

the lid cover including an inner cover and an outer cover, the inner cover placed in an inner rim of the outer cover, the locking portion of the lid cover mounted between the inner cover and the outer cover, the inner cover having a front end provided with a touch portion that may be pressed so as to pivot the inner cover to move upward independently, the top face of the connecting portion of the outer barrel having a front end defining a hanging recess, the inner barrel having a rear side having a top edge provided with a hanging hook portion secured in the hanging recess of the connecting portion of the outer barrel, the outer barrel having a back side provided with a hood, a plurality of screws each in turn extending through the hood, the outer barrel, and the connecting portion, so that the connecting portion is secured inside of a top portion of the outer barrel, and the hood is secured outside of the top portion of the outer barrel to form a handle portion of the outer barrel, such that the outer barrel is portable, and the lid cover of the waste bin structure can be opened by a triggering action, and by a stepping action of a foot.

Further benefits and advantages of the present invention will become apparent after a careful reading of the detailed description with appropriate reference to the accompanying drawings.

DETAILED DESCRIPTION OF THE INVENTION

Figure 1:
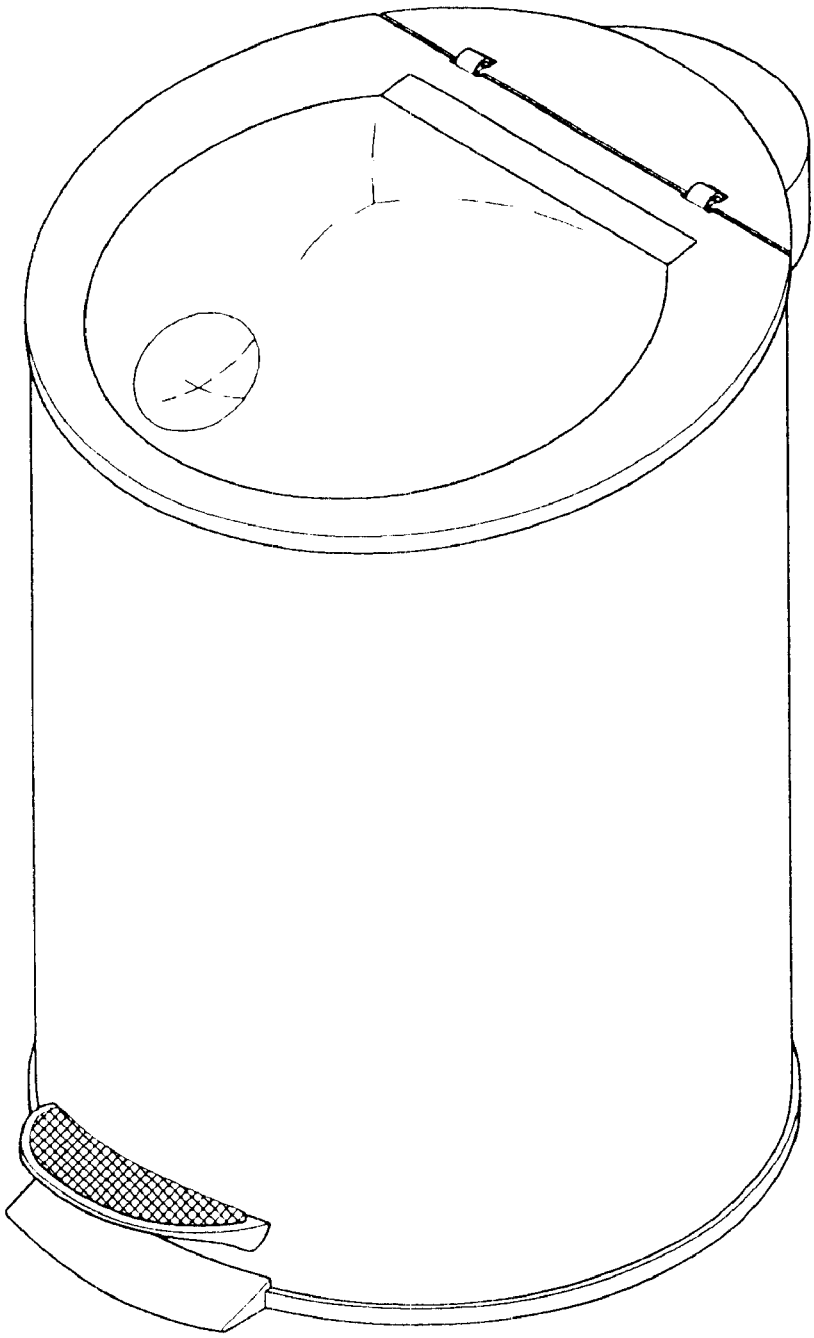
FIG. 1 is a perspective view of a waste bin structure in accordance with the present invention.
Figure 2:
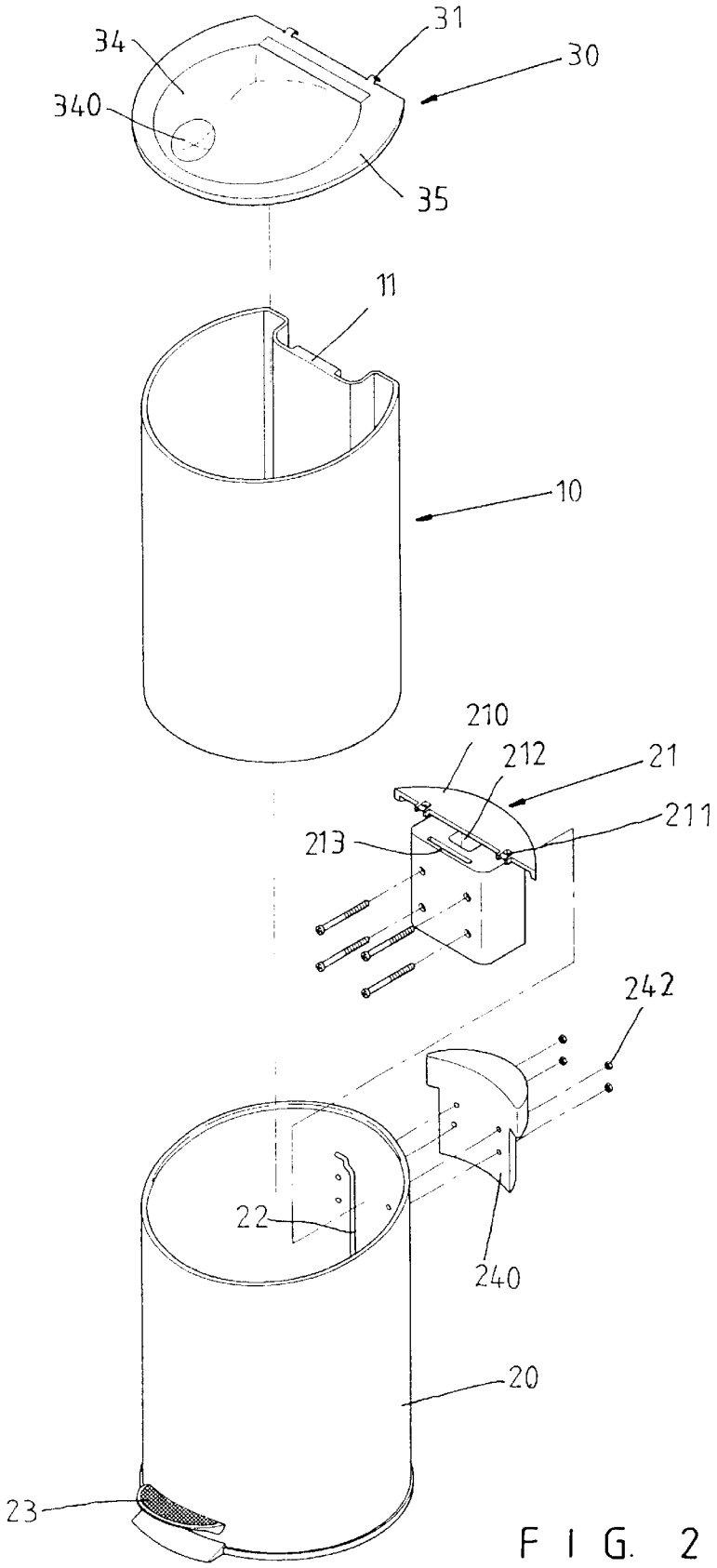
FIG. 2 is an exploded perspective view of the waste bin structure as shown in FIG. 1.
Figure 3:
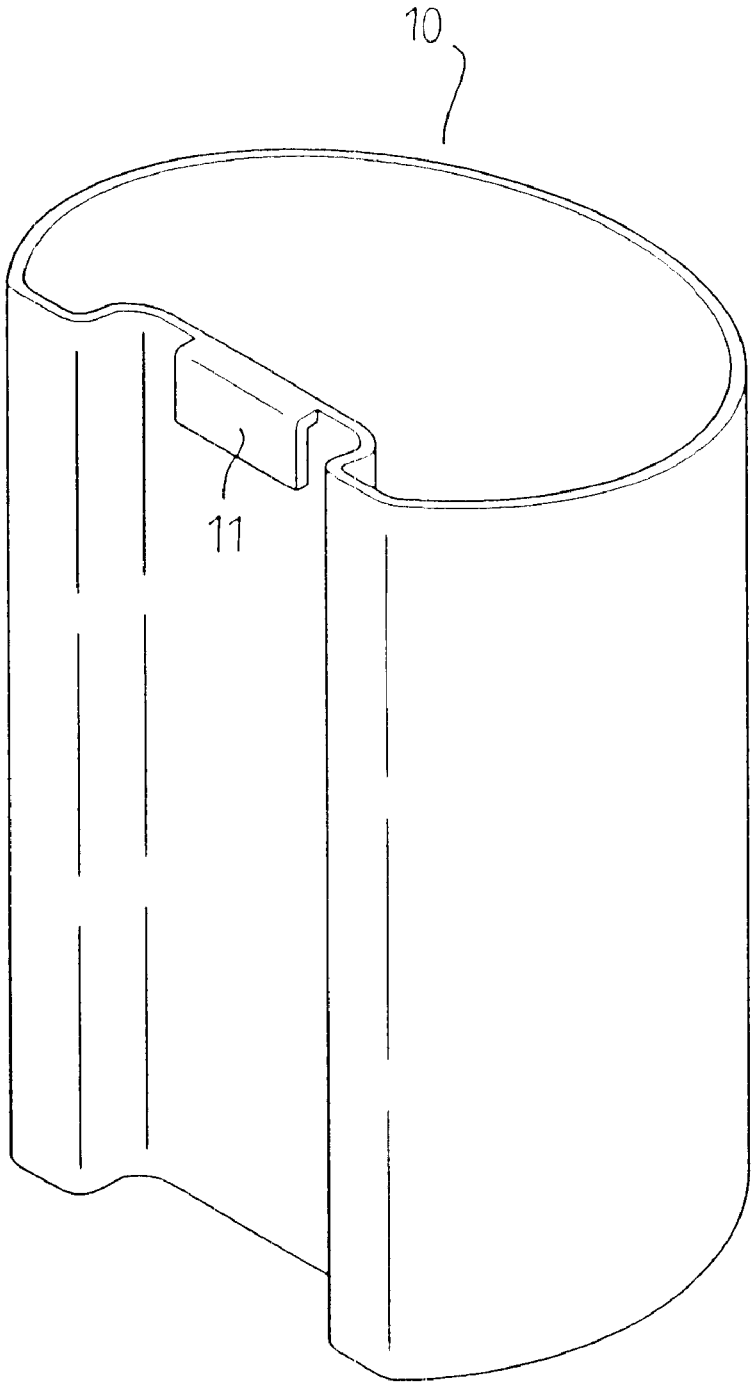
FIG. 3 is a perspective view of an inner barrel of the waste bin structure in accordance with the present invention.
Figure 4:
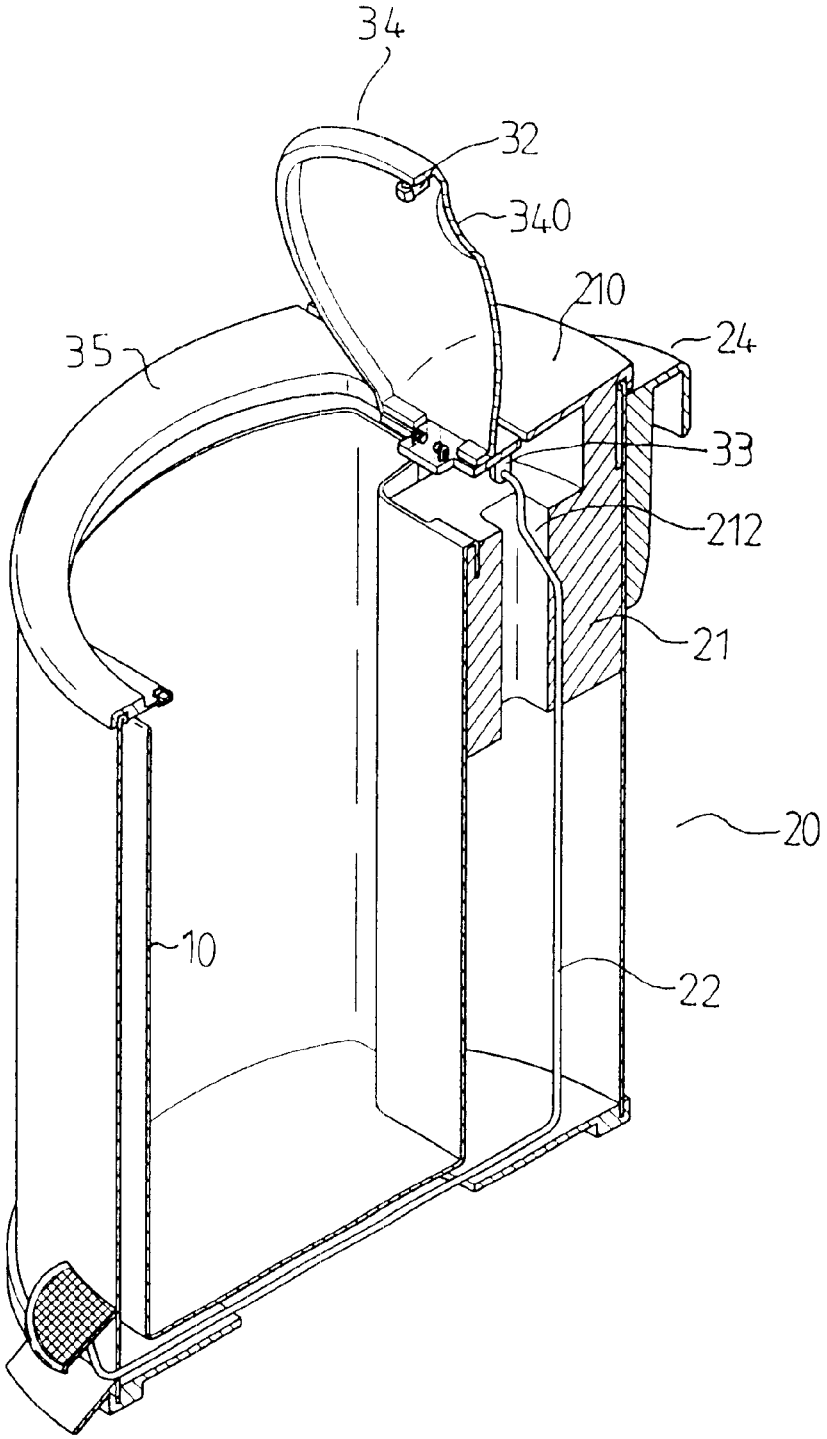
FIG. 4 is a partially cut-away cross-sectional view of the waste bin structure as shown in FIG. 1.
Figure 5:
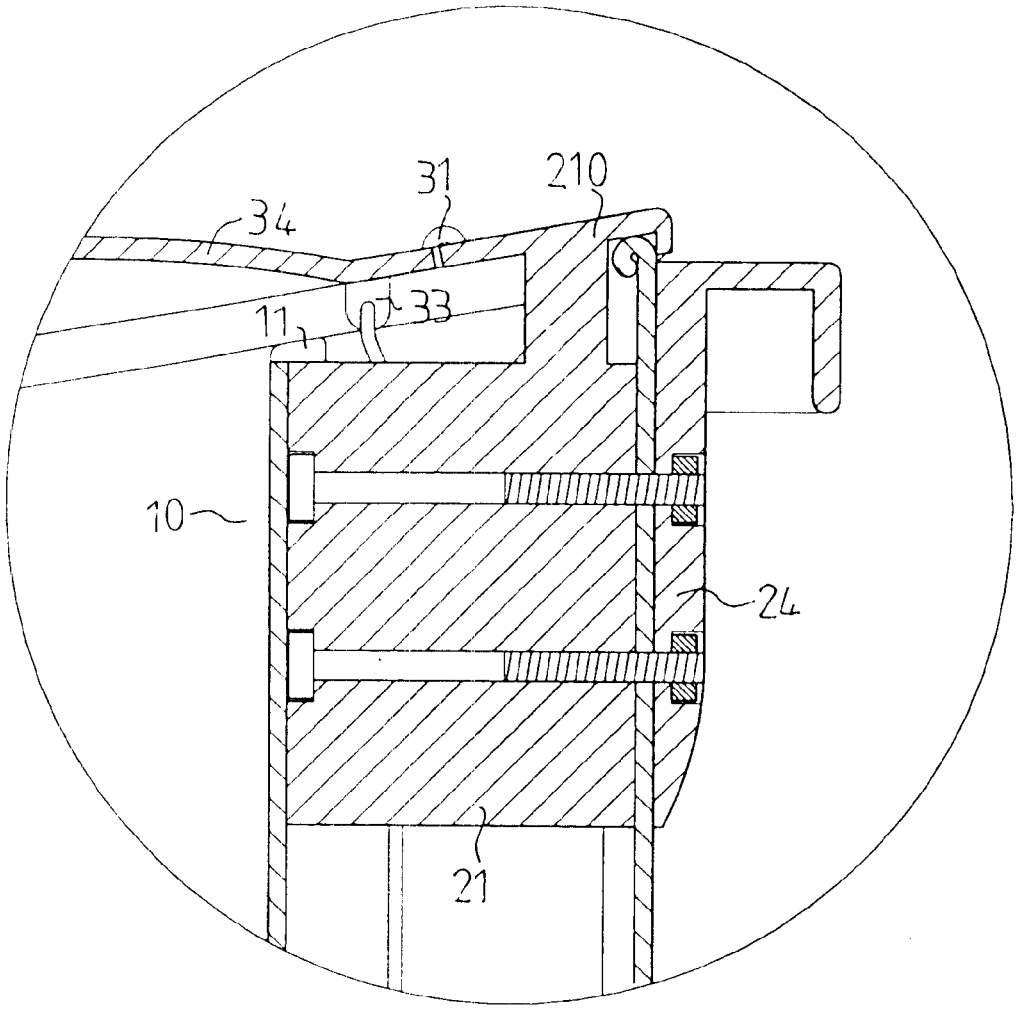
FIG. 5 is a top plan cross-sectional view of the waste bin structure as shown in FIG. 1.
Figure 6:
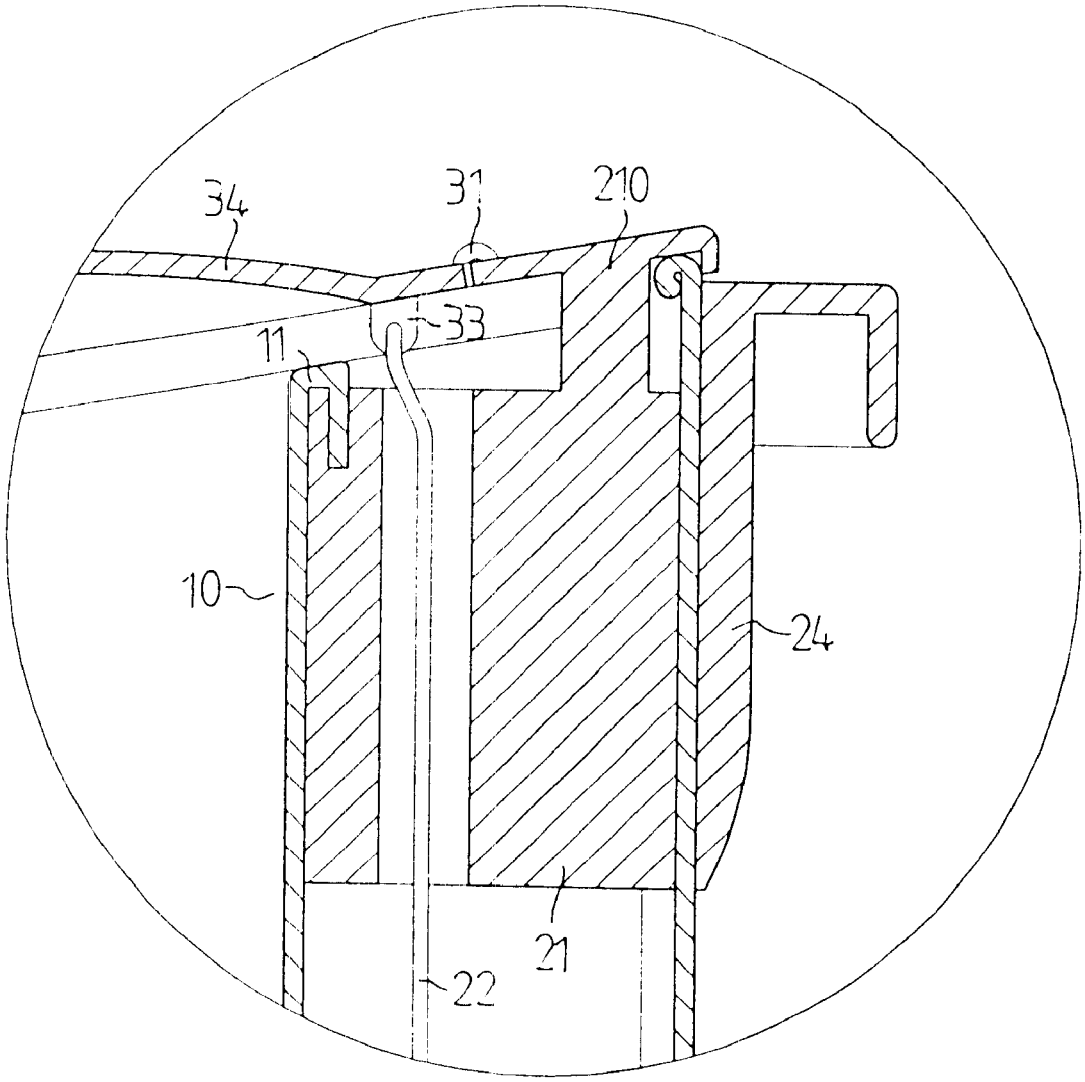
FIG. 6 is a top plan cross-sectional view of the waste bin structure as shown in FIG. 1.
Figure 7:
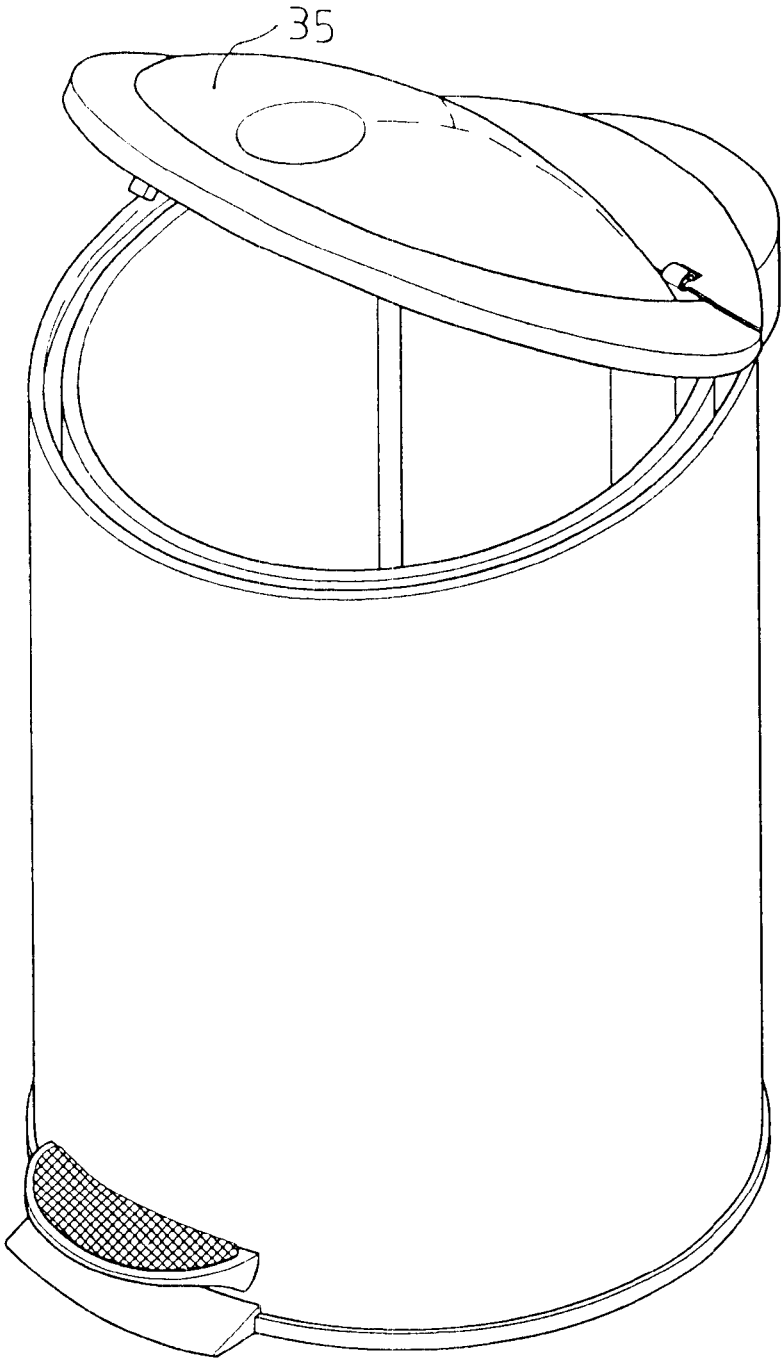
FIG. 7 is a schematic operational view of the waste bin structure as shown in FIG. 1 in use.

Referring to the drawings and initially to FIGS. 1–6, a waste bin structure in accordance with the present invention comprises an inner barrel 10, an outer barrel 20, and a barrel lid 30. The inner barrel 10 is received in the outer barrel 20. A connecting portion 21 is mounted on the rear end of the inner rim of the outer barrel 20. The connecting portion 21 has a top face integrally formed with a cover 210. The cover 210 has a front end provided with two hanging shafts 211. The barrel lid 30 has a distal end provided with two hanging ears 31 each snapped on the hanging shaft 211 of the cover 210 so that the barrel lid 30 covers the top edge of the outer barrel 20. The barrel lid 30 is provided with a locking portion 32 that is opened and closed by a triggering action, so that the barrel lid 30 can be opened by the triggering action. The connecting portion 21 of the outer barrel 20 has a center defining a channel 212. A linking lever 22 is received in the channel 212 and has a first end formed with a horizontal bent portion passing through a protruding ear 33 of the bottom of the rear end of the barrel lid 30, and a second end passing through the front end of the outer barrel 20 and pivoted with a pedal 23 which may be stepped so that the linking lever 22 pushes the lid cover 30 to pivot upward as shown in FIG. 7.

The improvement of the present invention will be described as follows.

The lid cover 30 includes an inner cover 34 and an outer cover 35. The inner cover 34 is placed in the inner rim of the outer cover 35. The locking portion 32 of the lid cover 30 is mounted between the inner cover 34 and the outer cover 35. The inner cover 34 has a front end provided with a touch portion 340 that may be pressed so as to pivot the inner cover 34 to move upward independently. The top face of the connecting portion 21 of the outer barrel 20 has a front end defining a hanging recess 213. The inner barrel 10 has a rear side having a top edge provided with a hanging hook portion 11 secured in the hanging recess 213 of the connecting portion 21 of the outer barrel 20 so that the inner barrel 10 can be secured on the front end of the connecting portion 21 of the outer barrel 20. The outer barrel 20 has a back side provided with a hood 240. A plurality of screws 242 each in turn extend through the hood 240, the outer barrel 20, and the connecting portion 21, such that the connecting portion 21 is secured inside of the top portion of the outer barrel 20, and the hood 240 is secured outside of the top portion of the outer barrel 20 to form a handle portion 24 of the outer barrel 20, such that the outer barrel 20 may be portable. In addition, the lid cover 30 of the waste bin structure can be opened by a triggering action, and by a stepping action of a foot so that the waste bin structure of the present invention has dual functions and effects.

Figure 8:
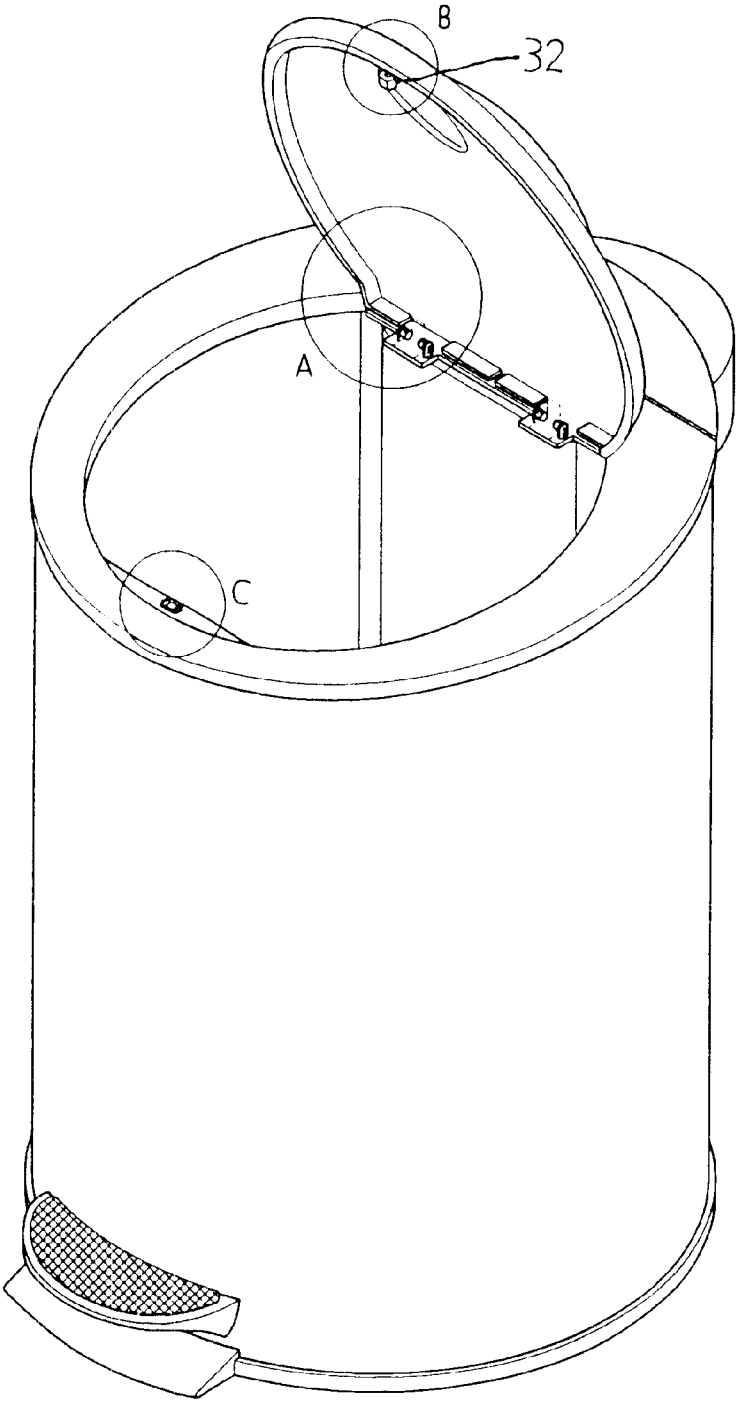
FIG. 8 is a schematic operational view of the waste bin structure as shown in FIG. 1 in use.
Figure 8A:
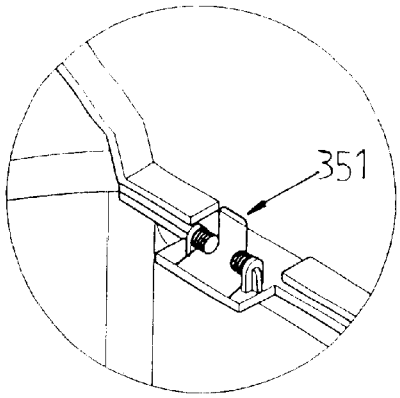
FIG. 8A is a partially enlarged view of the waste bin structure as shown in FIG. 8.
Figure 8B:
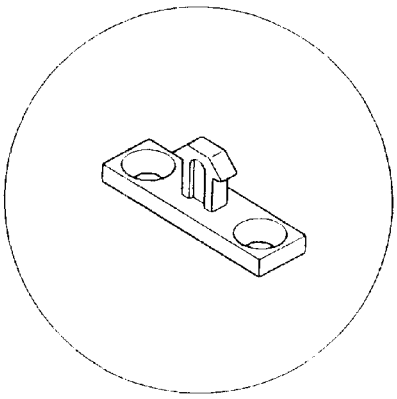
FIG. 8B is a partially enlarged view of the waste bin structure as shown in FIG. 8.
Figure 8C:
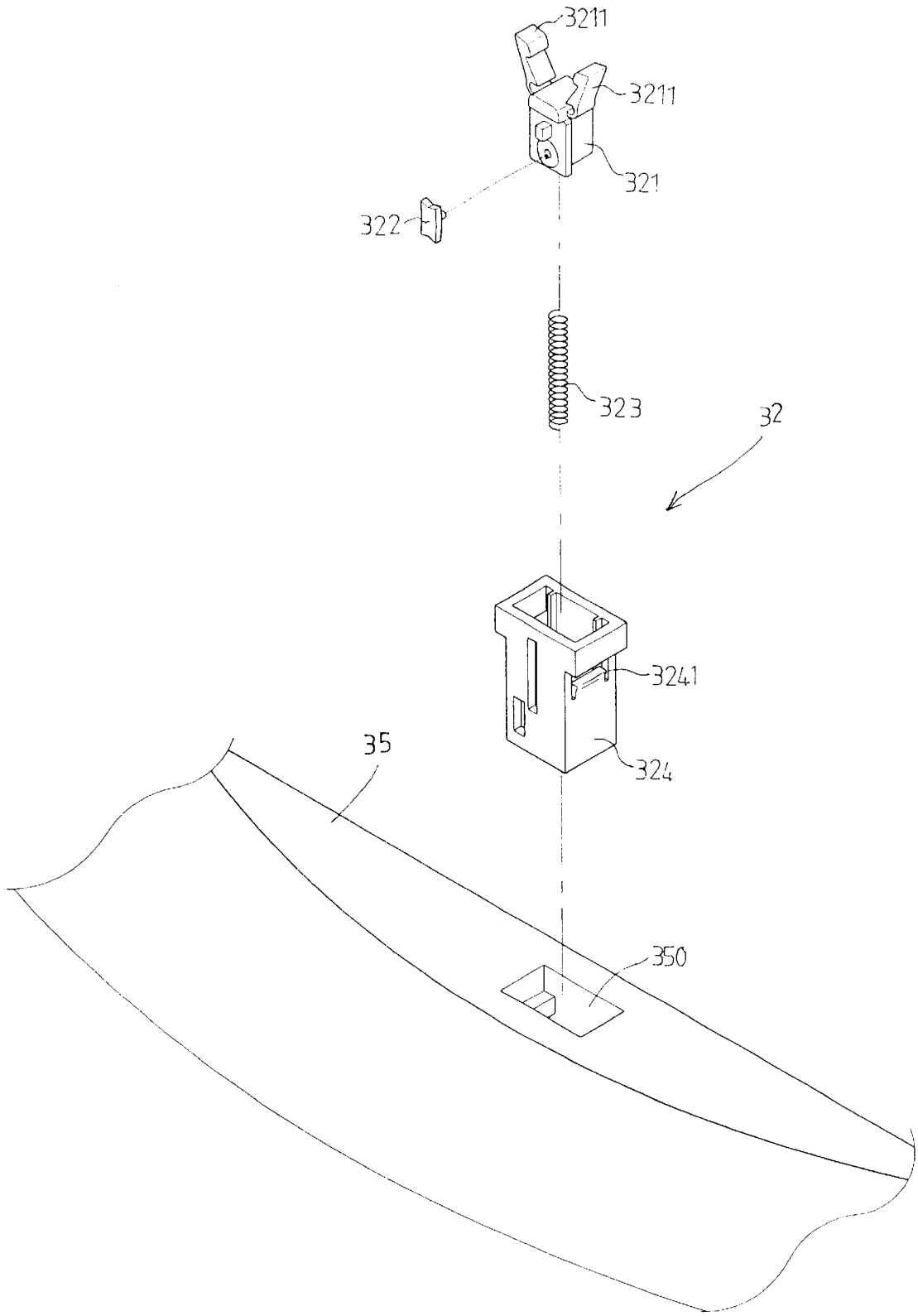
FIG. 8C is a partially enlarged exploded perspective view of the waste bin structure as shown in FIG. 8.
Figure 8D:
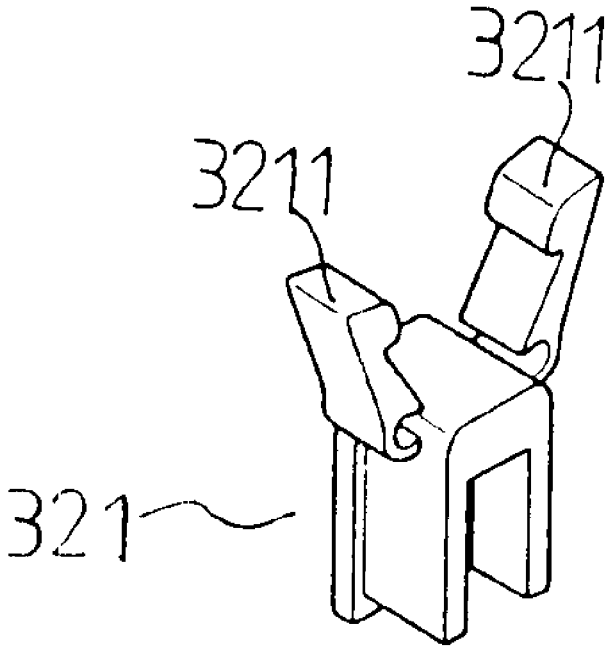
FIG. 8D is a perspective view a clip portion of the waste bin structure as shown in FIG. 8C.
Figure 9:
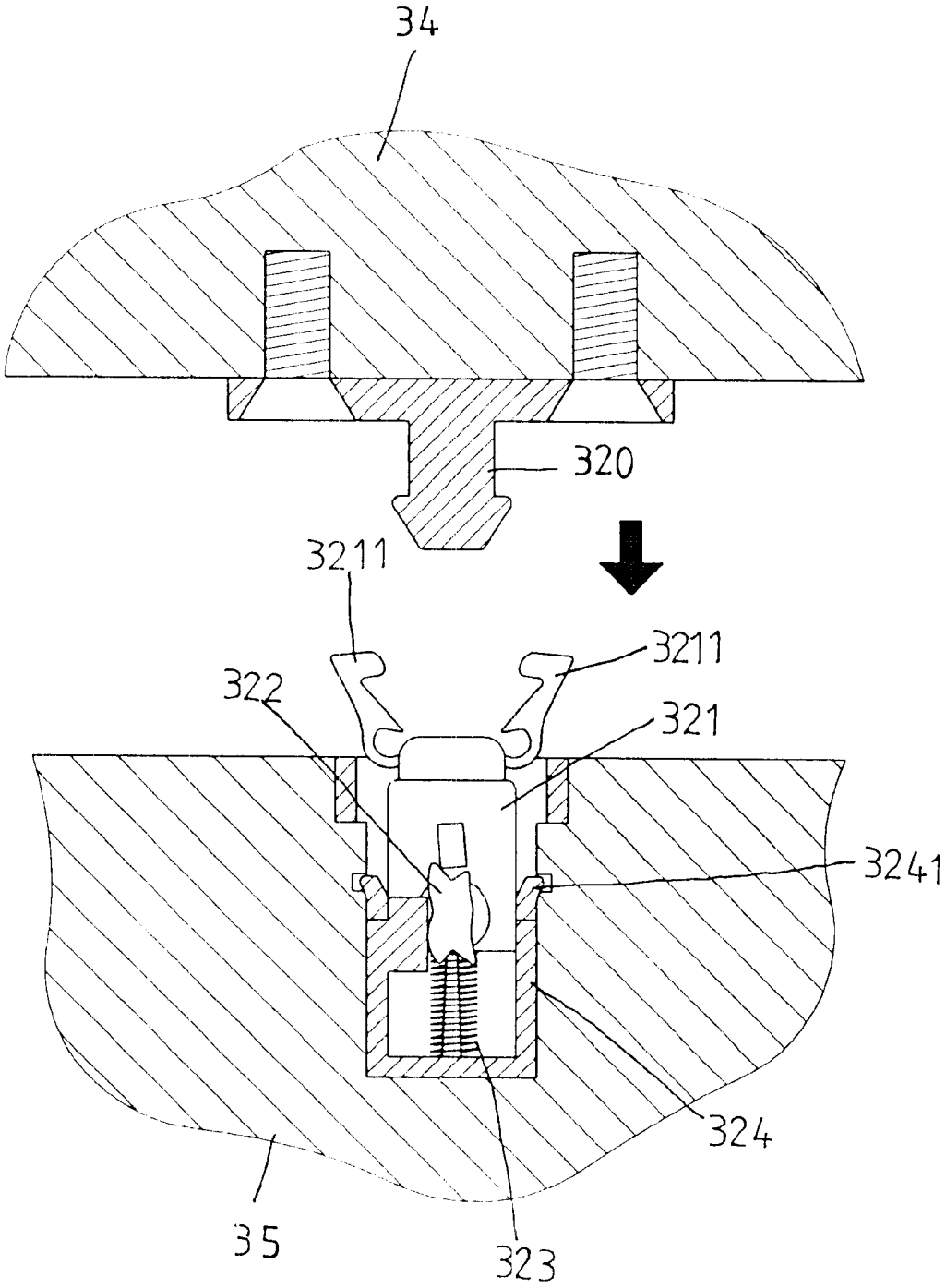
FIG. 9 is a front plan operational cross-sectional view of the waste bin structure as shown in FIG. 1.
Figure 10:
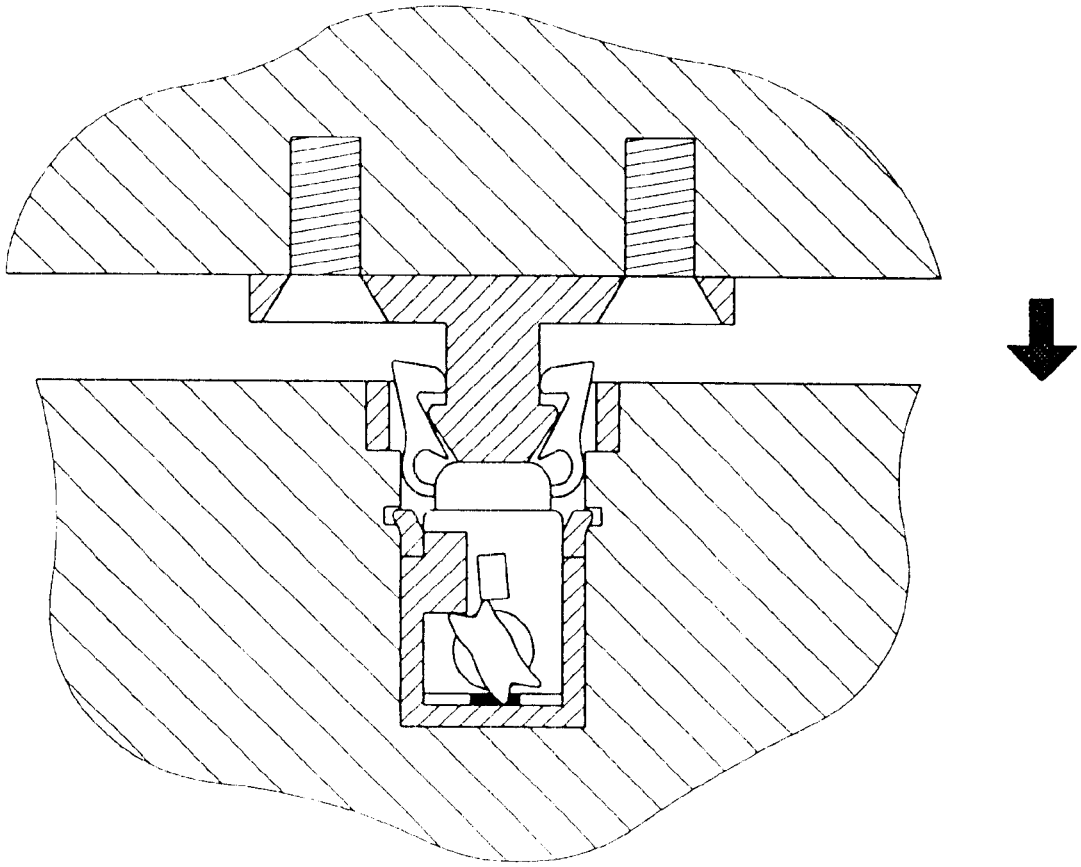
FIG. 10 is an operational view of the waste bin structure as shown in FIG. 9.
Figure 11:
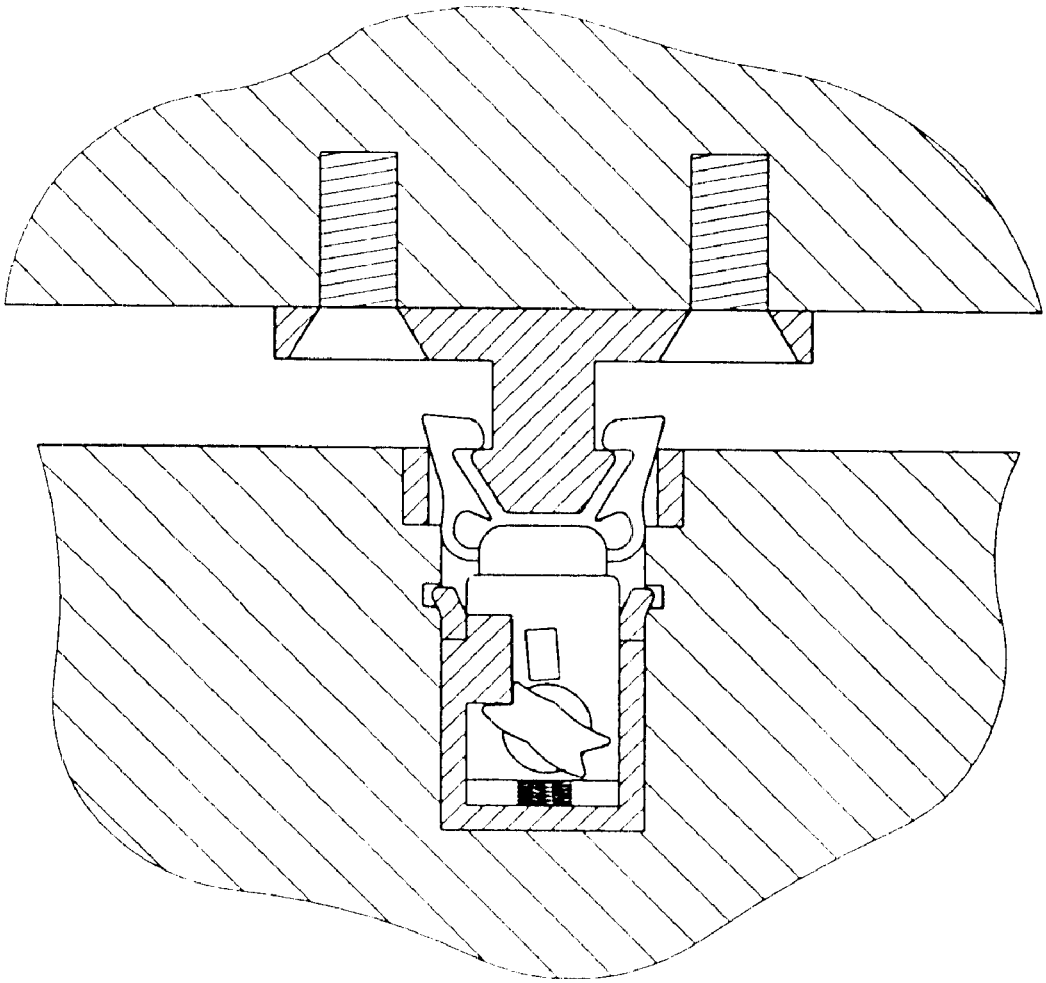
FIG. 11 is an operational view of the waste bin structure as shown in FIG. 10.

Referring to FIGS. 7–11, the rear end of the inner edge of the outer cover 35 of the lid cover 30 is provided with an elastic portion 351 as shown in FIG. 8A, for pivoting the distal end of the inner cover 34. When the locking portion 32 of the barrel cover 30 is disposed at a detachment state, the inner cover 34 can be pivoted upward by means of the elasticity of the elastic portion 351. The locking portion 32 of the barrel lid 30 includes a locking head 320, a clip portion 321, a locking piece 322, a spring 323, and a receiving seat 324. The locking head 320 has an arrow shape, and is secured to the front edge of the bottom face of the inner cover 34. The outer cover 35 has an inner edge having a front end defining a receiving recess 350 for receiving the T-shape receiving seat 324 of the locking portion 32. The receiving seat 324 has a side provided with a fixing piece 3241 for securing the receiving seat 324 in the receiving recess 350. The Y-shaped clip portion 321, the locking piece 322, and the spring 323 are received in the receiving seat 324 to operate. When the inner cover 34 is moved downward to press the outer cover 35, the locking head 320 secured on the inner cover 34 presses the clip portion 321 to move downward to compress the spring 323. Then, the clip hooks 3211 of the clip portion 321 are pressed to move toward each other by limit of the opening of the receiving seat 324 so as to clamp the locking head 320, while the locking piece 322 is rotated to be locked in the bottom end of the receiving seat 324 by means of the spring 323, so that the locking head 320 is disposed at a locked state. Then, after the touch portion 340 of the inner cover 34 is pressed, the clip portion 321 of the locking portion 32 will press the spring 323 again, so that the locking piece 322 is rotated to detach from the bottom end of the receiving seat 324. Subsequently, the clip portion 321 and the locking head 320 are moved upward by the restoring force of the spring 323, while the clip hooks 3211 of the clip portion 321 are moved outward relative to each other by means of the flexibility, so as to release the locking head 320, so that locking head 320 is disposed at a detachment state.

Accordingly, the waste bin structure in accordance with the present invention has simple parts that are pivoted with each other, so that the waste bin structure can be assembled easily, and has a cheaper cost of fabrication. In addition, the waste bin structure has an airtight effect so as to prevent wastes contained in the waste bin structure from directly contacting air of the ambient environment, thereby preventing leakage and spread of odor from the waste bin structure.

Although the invention has been explained in relation to its preferred embodiment as mentioned above, it is to be understood that many other possible modifications and variations can be made without departing from the scope of the present invention. It is, therefore, contemplated that the appended claim will cover such modifications and variations that fall within the true scope of the invention.

What is claimed is:

1. A waste bin structure comprising:

an inner barrel (10), an outer barrel (20), and a barrel lid (30), said inner barrel (10) received in said outer barrel (20), a connecting portion (21) mounted on a rear end of an inner rim of said outer barrel (20), said connecting portion (21) having a top face integrally formed with a cover (210), said cover (210) having a front end provided with two hanging shafts (211), said barrel lid (30) having a distal end provided with two hanging ears (31) each snapped on said hanging shaft (211) of said cover (210) so that said barrel lid (30) covers a top edge of said outer barrel (20), said barrel lid (30) provided with a locking portion (32) that is opened and closed by triggering, so that said barrel lid (30) can be opened by triggering action, said connecting portion (21) of said outer barrel (20) having a center defining a channel (212), a linking lever (22) received in said channel (212) and having a first end formed with a horizontal bent portion passing through a protruding ear (33) of a bottom of a rear end of said barrel lid (30), and a second end passing through a front end of said outer barrel (20) and pivoted with a pedal (23) which may be stepped so that said linking lever (22) pushes said lid cover (30) to pivot upward;

the improvement comprising:

said lid cover (30) including an inner cover (34) and an outer cover (35), said inner cover (34) placed in an inner rim of said outer cover (35), said locking portion (32) of said lid cover (30) mounted between said inner cover (34) and said outer cover (35), said inner cover (34) having a front end provided with a touch portion (340) that may be pressed so as to pivot said inner cover (34) to move upward independently, said top face of said connecting portion (21) of said outer barrel (20) having a front end defining a hanging recess (213), said inner barrel (10) having a rear side having a top edge provided with a hanging hook portion (11) secured in said hanging recess (213) of said connecting portion (21) of said outer barrel (20), said outer barrel (20) having a back side provided with a hood (240), a plurality of screws (242) each in turn extending through said hood (240), said outer barrel (20), and said connecting portion (21), so that said connecting portion (21) is secured inside of a top portion of said outer barrel (20), and said hood (240) is secured outside of said top portion of said outer barrel (20) to form a handle portion (24) of said outer barrel (20), such that said outer barrel (20) is portable, and said lid cover (30) of said waste bin structure can be opened by a triggering action, and by a stepping action of a foot.

* * * * *